US006272310B1

(12) United States Patent
Blair et al.

(10) Patent No.: US 6,272,310 B1
(45) Date of Patent: Aug. 7, 2001

(54) TONER FUSER SYSTEM HAVING POST-FUSER MEDIA CONDITIONER

(75) Inventors: Bryan Michael Blair, Lexington; Robert Leonard Burdick, Lancaster; James Allen Lokovich, Georgetown; Philip Jerome Heink, Lexington; Michael David Maul, Lexington; Matthew Lowell McKay, Lexington; Edward Alan Rush, Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/420,723

(22) Filed: Oct. 20, 1999

(51) Int. Cl.[7] ..... G03G 15/20
(52) U.S. Cl. ..... 399/341; 219/216
(58) Field of Search ..... 399/335–337, 399/341, 342; 219/216

(56) References Cited

U.S. PATENT DOCUMENTS 4,616,922 * 10/1986 Sobieski et al. .
4,992,923 * 2/1991 Mitsuya et al. ..... 399/336 X
4,996,563 * 2/1991 Blanding .
5,004,891 * 4/1991 Landis ..... 219/216 X
5,019,864 * 5/1991 Blanding .
5,099,288 * 3/1992 Britto et al. .
5,258,809 * 11/1993 Wiedemer .
5,408,302 * 4/1995 Manzer et al. .
5,640,660 * 6/1997 Takano et al. .
5,716,750 * 2/1998 Tyagi et al. .
5,805,969 * 9/1998 Elsermans et al. ..... 399/341
5,835,836 * 11/1998 Hirao ..... 399/336

* cited by examiner

*Primary Examiner*—William J. Royer
(74) *Attorney, Agent, or Firm*—Weingarten, Schurgin, Gagnebin & Hayes

(57) ABSTRACT

A toner fuser system suitable for producing high quality color transparencies is provided. The fuser system includes a media conditioning assembly located directly downstream of a fuser assembly, which may be a roll fuser or an instant-on belt fuser. The conditioner assembly includes a convective heat source, a heating zone, and a convective circulation path past the heat source and the heating zone to provide convective heat transfer to a transparency in the heating zone. A transparency (or other media) with toner to be fused travels on a media path first through the fuser assembly and then through the heating zone of the conditioner assembly. The fuser assembly causes toner to adhere to the transparency just well enough to allow the transparency to pass into the conditioner. In the conditioner, the toner is reheated, thereby causing the surface of the toner to reflow into a smooth, glossy, and uniform surface that increases light transmission efficiency of color transparencies. Additionally, the system eliminates the need for silicone oil, which is used in some prior art systems to prevent sticking of the transparency to the fuser assembly.

39 Claims, 3 Drawing Sheets

TONER FUSER SYSTEM HAVING POST-FUSER MEDIA CONDITIONER

BACKGROUND OF THE INVENTION

In electrophotographic (EP) printers and copiers, an image formed from developed thermoplastic toner is transferred to media such as paper, cardstock, labels, or transparencies. The toner is then fused to adhere the toner to the media. Current EP printers and copiers generally employ one of two types of fuser systems to adhere the toner to the media: a roll fuser system or an instant-on belt fuser system. Both fuser systems use a combination of temperature and pressure to melt and bond the thermoplastic toner either into the fibers of the paper or, in the case of transparencies, onto the surface of the film.

The first type of fuser system, the roll fuser system, comprises two rolls, of which either one or both has an elastomeric coating. Usually the bottom roll, typically known as the back-up roll (BUR), is spring loaded into the top roll, or hot roll (HR), although rolls with fixed centers are also used to create interference between the two rolls. The HR is the roll that contacts the unfused toner. The spring load, or interference in the case of fixed centered rolls, along with the elastomeric coating creates a nip, an area of high pressure and temperature that serves as the working area of the fusing system. The time that the media spends in the nip is known as the residence time or dwell time and is determined by the nip width and process speed of the media. Heat is typically provided by a lamp such as a halogen type lamp. The lamp is usually placed inside the HR, although it may be placed in both rolls or only in the BUR.

The second type of fuser system, the instant-on belt fuser system, comprises a polyamide belt, sometimes called a sleeve, and a soft silicon-coated back-up roll that are pressed together at a particular pressure to form a nip. This system may be an idling-belt system, in which the back-up roll is driven by a drive mechanism and the belt idles, or a driven-belt system, in which the belt is driven by a drive mechanism and the back-up roll idles. The belt in this system is thin, typically 0.10 mm or thinner. This system is called an "instant-on" fuser, because the thin belt wraps directly over the heating element, typically a ceramic type, at the nip, whereby the fuser reaches operating temperatures very quickly due to the lack of thermal mass between the heating element and media.

The roll fuser system is well known and in wider use than the instant-on belt fuser system. However, it has a few inherent drawbacks, especially in color EP applications. One problem with roll fusers is associated with the geometry of the rolls. In order to achieve acceptable fuse grade at faster speeds, a larger nip is needed to meet the required residence times. A common way to make the nip larger is to make the rolls larger. As the exit radius of curvature is increased, however, the release of the media from the surface of the hot roll becomes more difficult; there is a point at which the beam strength of the media is not great enough to overcome the adhesion force of the toner against the hot roll and the media follows the roll rather than properly releasing from the roll. Multi-colored prints are even more difficult to release due to the added pile height associated with mixing of the toner to make non-primary colors. Added pile height increases the tendency for the toner and therefore the media to stick to the hot roll.

A typical solution to prevent sticking of the media to the hot roll is to add silicone oil to the hot roll, thus providing a weak boundary layer between the toner and the hot roll.

Another advantage of silicone oil is that the weak boundary layer results in a smooth toner surface, which results in glossy images on paper and, more importantly, vibrant colors when projecting transparencies. Silicone oil, however, has several disadvantages. When oiled sheets are duplexed, oil is transported back through the machine, which may be detrimental to the EP process. Oil supply items can significantly increase the printed cost per page. The oil supply such as an oil roll, web, or oil bottle must be routinely replaced by the user, typically every five-to twenty-thousand sheets. Oil can leave a spotty residue on the sheet, and in the case of transparencies, residual oil can cause the sheets to stick together. Minimizing the quantity of oil metered to the printed sheet is challenging, because it is difficult to ensure consistent oil flow in all situations.

The belt fuser system is advantageous over the roll fuser system in that it allows for a sharp exit angle, which helps the release of the media from the belt without the need for silicone oil. The sharp release angle is formed either by wrapping the belt around a fairly sharp portion of the heater housing or allowing the belt to slacken at the exit portion. The beam stiffness of the media can thereby overcome the tendency of the media to follow the belt. The toner surface, however, is left rough, resulting in a matte finish and a non-translucent transparency that results in non-vibrant or 'muddy' looking colors when projected. This 'muddy' appearance is caused by scattering of the projector light by the non-flat toner surface.

Another disadvantage of the roll fuser system is the slower process speed needed for color transparencies. Because the optical properties of color transparencies are critical, the toner layers must be well mixed and the surface of the toner must be optically smooth with little or no voids and irregularities. To meet these requirements, the process speed for transparency fusing is slowed, so that the residence time can be increased and therefore more heat can be transferred to the toner. The paper-to-transparency speed ratio for color EP printers is typically 3 or 4 to 1, but some machines have ratios as high as 11 to 1. Also, the fuser temperature is increased so that the energy transferred to the transparency is much greater than for paper applications. Other disadvantages of the roll system compared to the instant-on belt fuser system are that warm-up time is longer and temperature swings are greater.

BRIEF SUMMARY OF THE INVENTION

The present invention provides a post-fuser media conditioning system operative in conjunction with a toner fuser assembly for an electrophotographic printer. In the fuser assembly, toner is initially fused by heat and pressure. Toner is then fully fused by convective heating in the post-fuser media conditioner.

The post-fuser media conditioning system comprises a conditioner assembly comprising an insulated heating chamber, a convective heat source, and a heating zone located within the heating chamber. A convective circulation path is provided within the heating chamber past the heat source and the heating zone to provide convective heat transfer to media in the heating zone. A media path is provided through the heating zone of the conditioner assembly.

The post-fuser media conditioner of the present invention allows for the elimination of silicone oil from the color EP fusing process. The fuser assembly may be a roll fuser or an instant-on belt fuser, which allows the advantages of either system to be chosen, as desired. The present invention achieves a significant increase in the fusing speed of color transparencies relative to a similar sized fuser with oil. A similar sized fuser with the post-fuser media conditioner may increase the speed at least three-fold and yet still achieve vibrant color transparencies. The transparency speed is a function of the post-fuser media conditioner's ability to transfer heat to the toner. In a further embodiment, the post-fuser media conditioner provides a mechanism to change parameters that effect the surface properties of the toner, allowing users to adjust the toner gloss on paper according to their preference.

DESCRIPTION OF THE DRAWINGS

The invention will be more fully understood from the following detailed description taken in conjunction with the following drawings in which.

DETAILED DESCRIPTION OF THE INVENTION

Figure 1:
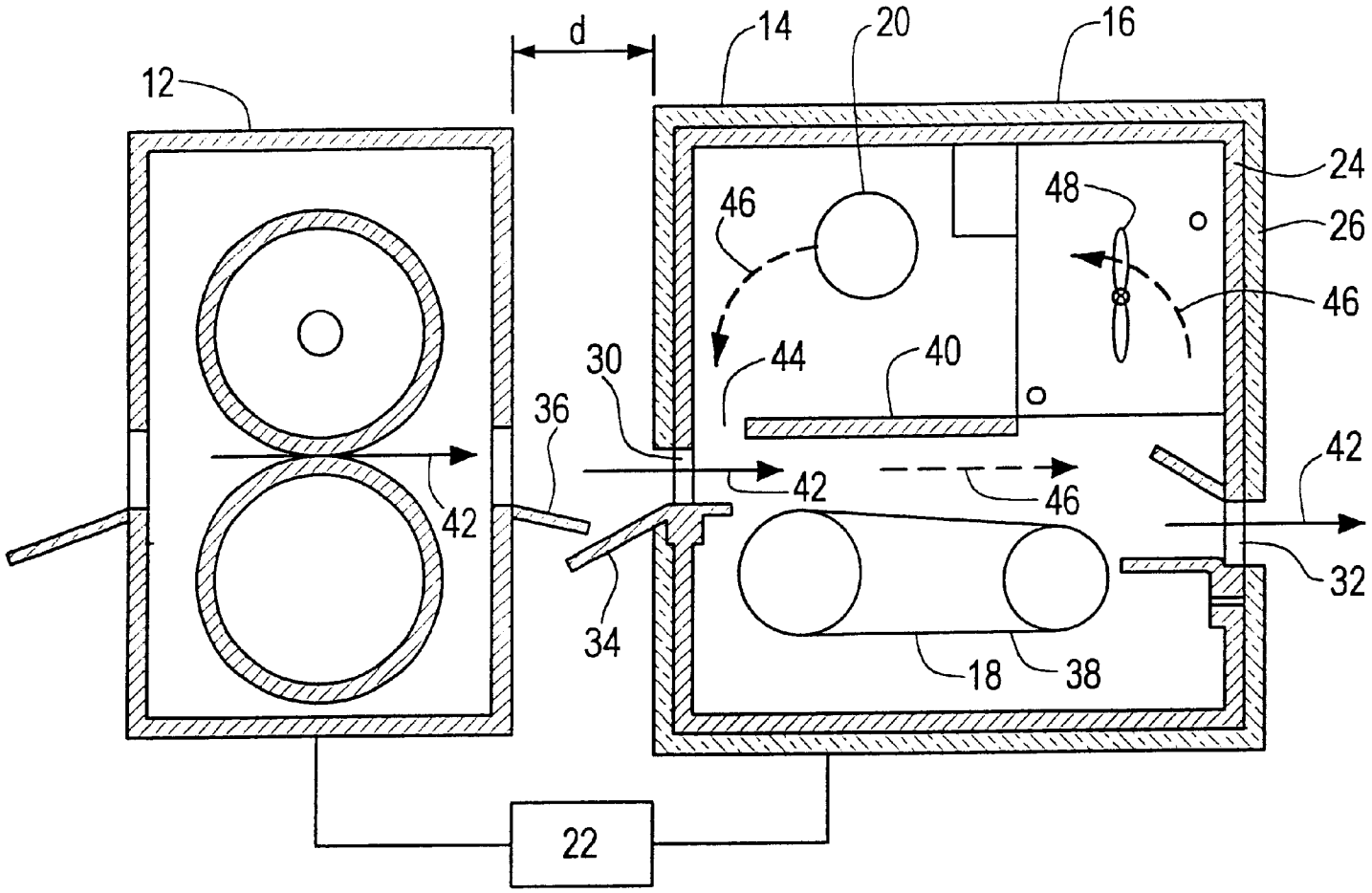
FIG. 1 schematically illustrates a first embodiment of a post fuser media conditioner according to the present invention.

FIG. 1 illustrates a fuser system incorporating a fuser assembly 12 and a post-fuser media conditioner assembly 14 according to the present invention. The fuser assembly 12 may utilize a roll fuser, an instant-on belt fuser, or any other type of fusing system. The media conditioner 14 comprises an insulated, convective heating chamber 16 located downstream of the fuser assembly 12. A media transport mechanism 18 to carry media through the conditioner and a heat source 20 are located within the chamber 16. The fuser assembly causes toner on the media to adhere to the media just well enough to allow the media to pass into the conditioner without sticking to the fuser assembly. The media passes through a heating zone in the chamber. While the media is in the heating zone, the heat source 20 heats the toner sufficiently to cause its surface to reflow into a smooth, glossy, and uniform surface. A suitable controller 22 is provided to control the fuser assembly and media conditioner.

The heating chamber 16 is formed to withstand the temperature of the heat source and to retain as much heat as possible. For example, the chamber may be formed of a casing 24 of metal, such as aluminum, covered or coated with one or more layers 26 of a thermally insulative material. A further outer layer of an insulative plastic material (not shown) is preferably provided as well. A layer of heated air (not shown) may also be provided for insulation.

A media entrance 30 is provided in one side of the heating chamber 16 adjacent the fuser assembly 12, and a media exit 32 is provided in the opposite side. The media is fed from the fuser assembly 12 directly into the post-fuser media conditioner 14. The distance d between the fuser assembly and the media conditioner is minimized to retain the maximum amount of heat in the media before entering the conditioner. An entrance guide 34 and an exit guide 36 may be used to direct media from the fuser assembly 12 into the conditioner 14. The media transport mechanism 18 within the chamber 16 transports media through the chamber from the entrance to the exit. The transport mechanism may be a transport belt 38 within the heating zone, as illustrated in FIG. 1, or any other suitable structure, such as rollers. Alternatively, the fuser assembly may push the media through the heating zone in the chamber. Additionally or alternatively, the media may be picked up by rollers outside of the heating zone.

The convective heat source 20 in the chamber may comprise, for example, one or more quartz heater bulbs, one or more halogen bulbs, a resistance heater assembly, or re-circulated heated air from the fuser assembly. A combination of different heat sources may also be used, such as recirculated heated air from the fuser assembly in combination with a quartz or halogen bulb. A shield plate 40 is preferably provided between the heat source 20 and the media path 42 through the heating zone to prevent radiant energy from impinging on the media, because radiant energy is unevenly absorbed by the different colors of toner. An opening 44 or vent in front of the shield plate 40 near the media entrance 30 allows air to circulate down to the media path. Preferably, a circulation path that allows air to recirculate past the heat source, indicated by dashed arrows 46, is provided. A blower assembly 48, such as a fan, may also be provided to assist in the circulation of as much heat as possible. Circulation of air maximizes system efficiency by maximizing heat transfer to the media and minimizing heat loss through the exit.

Media that passes through a fuser assembly is typically not flat. Non-flat media must be able to pass through the conditioner 14 without jamming or allowing the soft toner to contact any portion of the conditioner that might cause smearing. Also, down side duplexed sheets are toner covered and thus when in the conditioner, the soft toner contacts the transport assembly of the conditioner, if present. The toner must not be damaged when this occurs, and the transport assembly of the conditioner must not become contaminated with toner or paper jams may occur. For these reasons, the transport assembly of the conditioner may utilize a ribbed transport belt, star wheels, a cooled surface, or a low surface energy surface that resists toner contamination, such as a PTFE or VITON® coating. Alternatively, the conditioner may be deactivated when the printer is utilized in duplex mode, which would result in matte-finished duplex jobs. For example, the heat source in the conditioner may be turned off. In this case, the blower assembly 48 preferably continues to run to provide a faster cool down. Additionally, the conditioner may be movable to move out of the media path. Similarly, another media path may be provided outside of the conditioner.

The fuser assembly 12 and media conditioner 14 are controlled by any suitable controller 22. Under control of the controller, the fuser assembly causes the toner to adhere to the transparency just well enough to allow the media to pass into the conditioner. The media conditioner reheats the toner after it passes through the fuser, causing the surface of the toner to reflow into a smooth, glossy, and uniform surface. This smoothing effect increases the light transmission efficiency of the color transparencies. By underfusing the toner in the fuser pass, the risk of hot offsetting is minimized and also energy consumption is minimized. The underfusing and subsequent conditioning are controlled by a suitable controller. The degree of fusing is determined by the parameters of time, temperature, and pressure in the fuser or conditioner and the type of toner. The pressure and time in the fuser assembly are preset during manufacture of the fuser assembly and the media conditioner. The temperature for underfusing the toner is then determined as a function of these parameters and the type of toner, as would by understood by those of skill in the art, and is controlled by the controller. A typical temperature range may be 140 to 210° C.

The entire system is encased in order to maximize the efficiency of the system, which promotes low energy consumption as well as minimizing the temperature gradient of the system. The air flow at the media surface interface is made to be turbulent for optimal heat transfer to the toner. For example, the fan speed may be set sufficiently high and/or baffles may be provided to increase collisions with the air molecules or channel the airflow through a smaller area before impinging on the media on the transport assembly. In general, the design of the post-fuser media conditioner attempts to maximize efficiency and minimize the envelope size or volume, while producing smooth, uniform toner surfaces that exhibit high gloss and excellent light transmission.

The invention solves the problems associated with silicone oil as described above. Other advantages of this system include higher transparency throughput since the media conditioner gives the toner its good optical properties. The cost per page is lower, because an oil supply does not need to be replaced. Less customer interaction is needed with the machine due to the lack of an oil supply. No oil residue is left on media.

Also, in a further embodiment, the media conditioner allows a user the option of choosing the gloss on the media through the operator panel by changing the media conditioner's parameters of temperature and speed of the media through the conditioner. For example, a user may choose the degree of gloss on a control panel, and the controller then sets the temperature and speed appropriate to the chosen degree of gloss. In general, the greater the temperature is in the conditioner and the slower the media passes through the conditioner, the greater the gloss level on the media.

Figure 2:
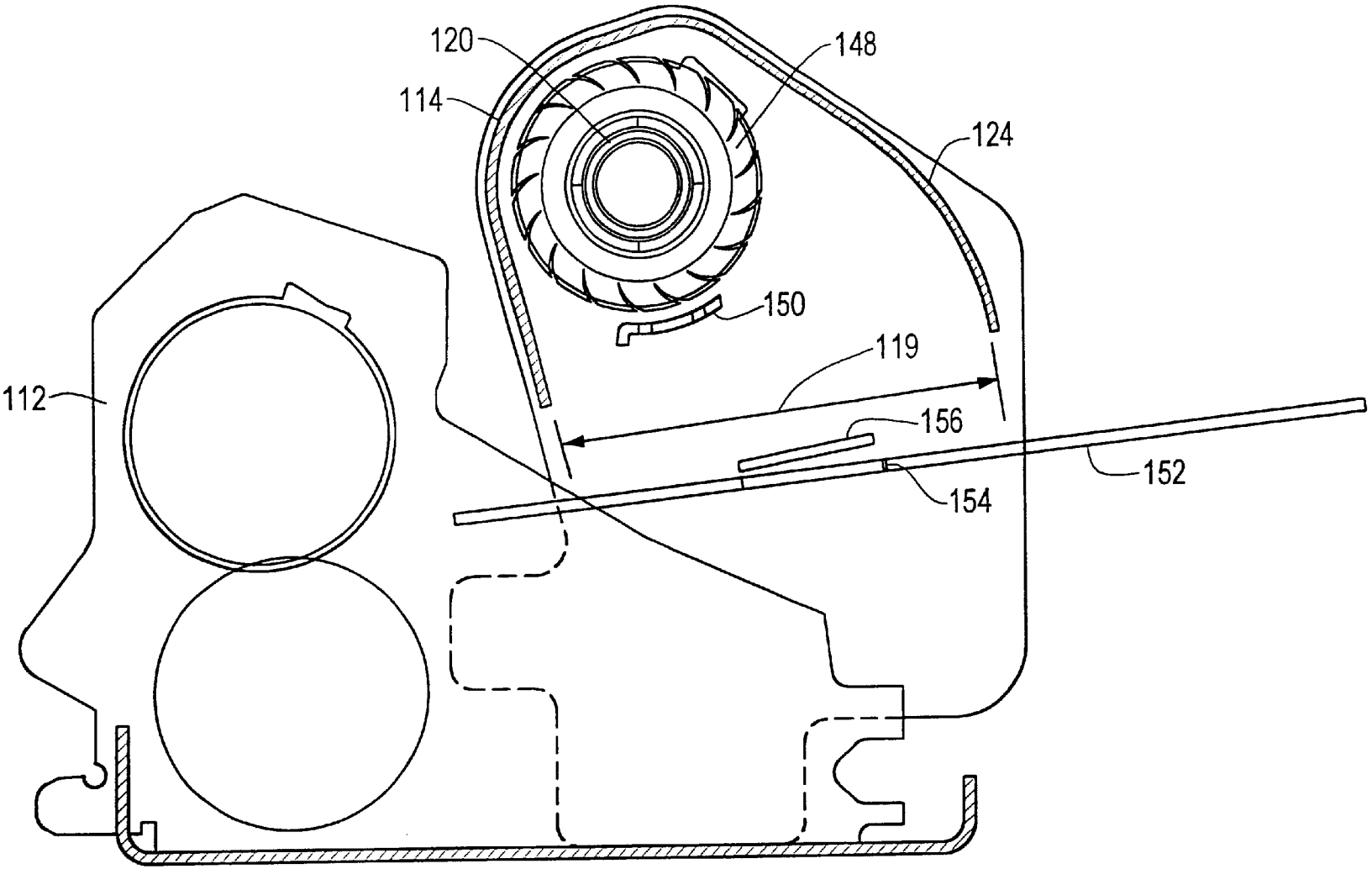
FIG. 2 illustrates a second embodiment of a post fuser media conditioner according to the present invention.

FIG. 2 shows another embodiment of the present invention, in which the post-fuser conditioner is more closely integrated with the fuser assembly. The fuser assembly and the media conditioner are preferably contained in a single housing. Media passes through the fuser assembly 112 and into a heating zone 119. A heat source 120 is provided in the interior of a blower assembly 148 in a region above the media path defined by a casing 124, which is preferably insulated. A baffle 150 directs the circulation of heated air toward the media path while blocking radiant energy from impinging on the media. The transport assembly includes a plate 152 upon which the media slides as it passes through the media conditioner. The fuser assembly 112 is sufficiently close to the media conditioner 114 to push media through the media conditioner on the plate 152. The plate may be adjustable to accommodate different media paths, if desired. For example, the plate is mounted in slots in opposed interior sidewalls of the chamber (only one slot 154 is shown). A second set of slots (only one slot 156 is shown) is provided at a different level to allow adjustment of the level of the plate, if desired.

Figure 3:
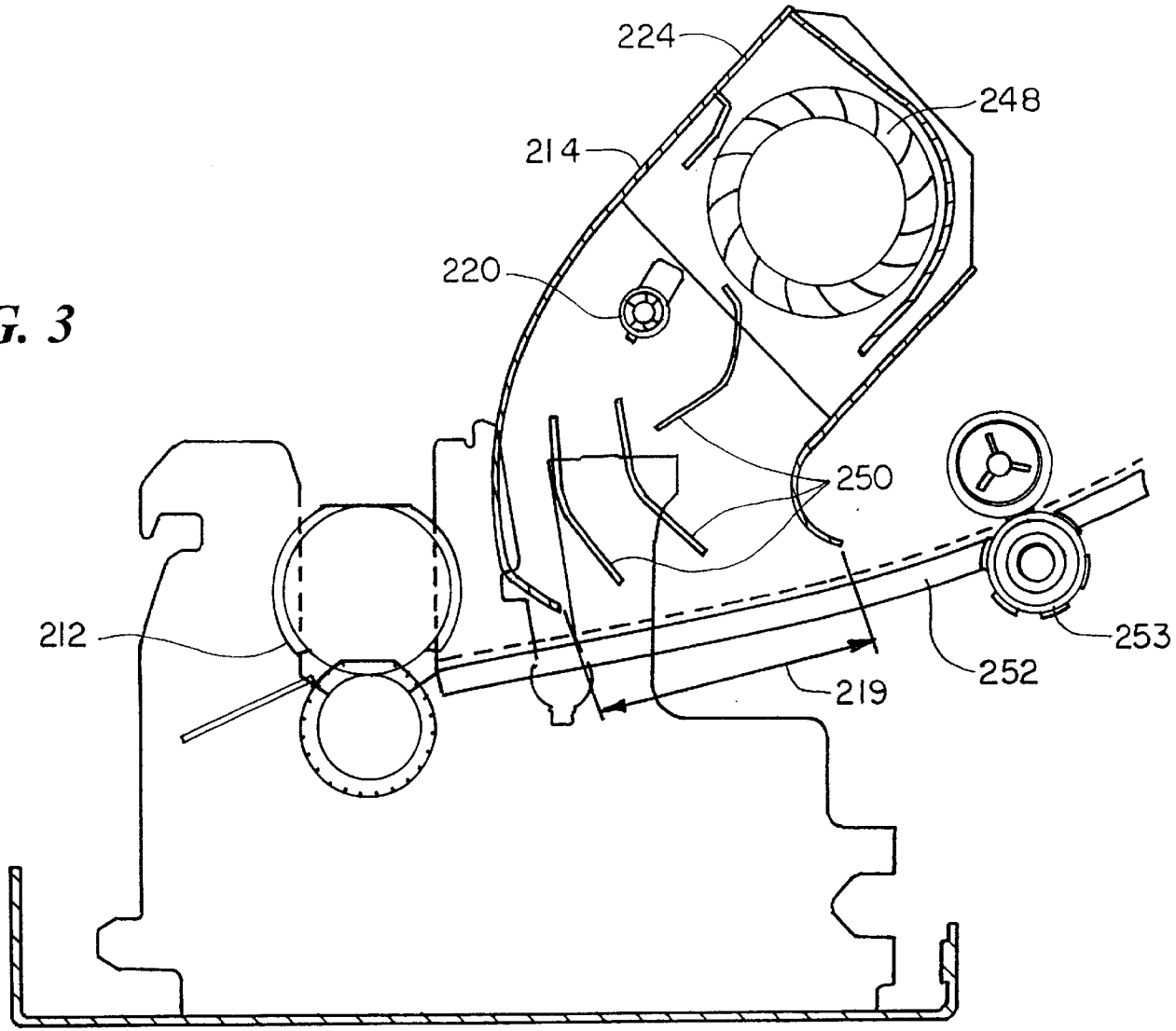
FIG. 3 illustrates a third embodiment of a post fuser media conditioner according to the present invention.

A still further embodiment is illustrated in FIG. 3, in which a post fuser media conditioner 214 is mounted to the housing of a fuser assembly 212. Media passes through the fuser assembly and into a heating zone 219 in the conditioner 214. A heat source 220 and blower assembly 248 are provided inside a casing 224. Baffles 250 direct the circulation of heated air toward the media, while blocking radiant energy from impinging on the media. The transport assembly includes a plate 252 upon which the media slides as it passes through the heating zone 219 in the media conditioner. A transport roll assembly 253 outside of the casing 224 assists in pulling the media through the conditioner.

It should be appreciated that other embodiments having different configurations of the media conditioner components, the transport assembly, the heat source, the blower, and the shield plate or plates, may be provided.

We claim:

1. A toner fuser system for an electrophotographic printer comprising:

a fuser assembly comprising a pressure application region and a heat source located to heat the pressure application region;

a media conditioner assembly comprising a convective heat source and a heating zone and at least one shield plate located to block radiant heat from the convective heat source from entering the heating zone and a convective circulation path past the convective heat source and the heating zone to provide convective heat transfer to media in the heating zone; and a media path including an upstream portion through the pressure application region of the fuser assembly and a downstream portion through the heating zone of the media conditioner assembly.

2. The toner fuser system of claim 1, wherein the media conditioner assembly further comprises an insulated heating chamber, and the convective heat source and the heating zone are located within the insulated heating chamber.

3. The toner fuser system of claim 2, wherein the insulated heating chamber further includes a layer of heated gas.

4. The toner fuser system of claim 3, wherein the layer of heated gas comprises recirculated heated gas from the fuser assembly.

5. The toner fuser system of claim 1, wherein the convective heat source includes a quartz heater bulb, a halogen bulb, or a resistance heater, or recirculated heated gas from the fuser assembly.

6. The toner fuser system of claim 1, wherein the convective heat source includes a quartz heater bulb, a halogen bulb, or a resistance heater, and the convective heat source further includes recirculated heated gas from the fuser assembly.

7. The toner fuser system of claim 1, wherein the media conditioner assembly further includes a blower mechanism located in the convective circulation path to assist circulation of gas heated by the convective heat source.

8. The toner fuser system of claim 7, wherein the convective heat source is located within the blower mechanism.

9. The toner fuser system of claim 1, wherein the media conditioner assembly further includes a transport mechanism configured to transport the media through the heating zone on the media path.

10. The toner fuser system of claim 9, wherein the transport mechanism comprises a transport belt or rollers.

11. The toner fuser system of claim 10, wherein the transport belt comprises a ribbed belt.

12. The toner fuser system of claim 9, wherein the transport mechanism includes a cooled surface.

13. The toner fuser system of claim 9, wherein the transport mechanism includes a low surface energy surface.

14. The toner fuser system of claim 9, wherein the fuser assembly forms at least a portion of the transport mechanism operative to push media through the media conditioner assembly.

15. The toner fuser system of claim 9, wherein the transport mechanism includes a plate within the heating zone.

16. The toner fuser system of claim 15, wherein the plate is adjustably located within the heating zone.

17. The toner fuser system of claim 9, wherein the transport mechanism is located at least partially in the heating zone.

18. The toner fuser system of claim 9, wherein the transport mechanism is located downstream of the heating zone.

19. The toner fuser system of claim 1, wherein the fuser assembly comprises an instant-on belt fuser.

20. The toner fuser system of claim 1, wherein the fuser assembly comprises a roll fuser.

21. The toner fuser system of claim 1, wherein the media conditioner assembly and the fuser assembly are located in a common housing.

22. The toner fuser system of claim 1, further comprising a controller in communication with the fuser assembly and the media conditioner assembly.

23. The toner fuser system of claim 22, wherein the controller is operative to control the temperature of the convective heat source and the speed of the media on the media path.

24. A post-fuser media conditioning system operative in conjunction with a toner fuser assembly for an electrophotographic printer, comprising:

a conditioner assembly comprising an insulated heating chamber, a convective heat source, and a heating zone located within the insulated heating chamber, and at least one shield plate located to block radiant heat from the convective heat source from entering the heating zone, and a convective circulation path within the insulated heating chamber past the convective heat source and the heating zone to provide convective heat transfer to media in the heating zone; and a media path through the heating zone of the conditioner assembly.

25. The post-fuser media conditioning system of claim 24, wherein the convective heat source includes a quartz heater bulb, a halogen bulb, or a resistance heater.

26. The post-fuser media conditioning system of claim 24, wherein the conditioner assembly further includes a blower mechanism located on the convective circulation path to assist circulation of gas heated by the convective heat source.

27. The post-fuser media conditioning system of claim 26, wherein the convective heat source is located within the blower mechanism.

28. The post-fuser media conditioning system of claim 24, wherein the conditioner assembly further includes a transport mechanism configured to transport the media through the heating zone on the media path.

29. The post-fuser media conditioning system of claim 28, wherein the transport mechanism comprises a transport belt or rollers.

30. The post-fuser media conditioning system of claim 28, wherein the transport mechanism includes a cooled surface or a low surface energy surface.

31. The post-fuser media conditioning system of claim 28, wherein the transport mechanism further includes a plate.

32. A method of fusing toner to media in an electrophotographic printer, comprising:

providing media with unfused toner thereon;

in a first fusing operation, passing the media through a region of high pressure and high temperature to cause the unfused toner to partially fuse to the surface of the media; and in a second fusing operation, passing the media through a convective heating zone downstream of the first fusing operation, blocking radiant energy from impinging on the media in the heating zone, to cause the partially fused toner to fully fuse to the surface of the media.

33. The method of claim 32, further comprising in the second fusing operation, providing a blower to assist circulation of heated gas past the heating zone.

34. The method of claim 32, further comprising repeating the first fusing operation and the second fusing operation on a second side of the media.

35. The method of claim 32, wherein in the media providing step, the media comprises a transparency.

36. The method of claim 32, wherein in the media providing step, the toner comprises colored toner.

37. The method of claim 32, wherein the first fusing operation comprises controlling the temperature and time of the media in the region of high pressure and high temperature to achieve a desired degree of partial fusing.

38. The method of claim 32, wherein the second fusing operation comprises controlling the temperature and time of the media in the convective heating zone to achieve a desired degree of fusing.

39. The method of claim 32, wherein the second fusing operation further comprises adjusting the temperature and time of the media in the convective heating zone to achieve a desired degree of toner glossiness on the media.

* * * * *